US008907792B2

(12) United States Patent
Mezger

(10) Patent No.: US 8,907,792 B2
(45) Date of Patent: Dec. 9, 2014

(54) THEFT PROTECTION DEVICE AND METHOD FOR THE DETECTION OF UNAUTHORIZED INTRUSION OR ENTRANCE

(75) Inventor: Matthias Mezger, Oberkirch (DE)

(73) Assignee: Sick AG, Waldkirch (DE)

( * ) Notice: Subject to any disclaimer, the term of this patent is extended or adjusted under 35 U.S.C. 154(b) by 259 days.

(21) Appl. No.: 13/428,664

(22) Filed: Mar. 23, 2012

(65) Prior Publication Data

US 2012/0274466 A1 Nov. 1, 2012

(30) Foreign Application Priority Data

Apr. 28, 2011 (EP) ..... 11164049

(51) Int. Cl.
*G08B 13/18* (2006.01)
*G08B 13/183* (2006.01)

(52) U.S. Cl.
CPC ..... *G08B 13/183* (2013.01)
USPC ..... 340/557; 340/5.6; 348/152; 705/18

(58) Field of Classification Search
USPC ..... 340/555–557, 539.13, 573.4, 5.2, 5.3, 340/5.6, 5.61, 5.64, 5.8, 5.81; 348/143, 348/152; 705/16, 18, 22; 250/221
See application file for complete search history.

(56) References Cited

U.S. PATENT DOCUMENTS 4,656,463 A * 4/1987 Anders et al. ..... 340/573.4
6,720,874 B2 * 4/2004 Fufido et al. ..... 340/556
7,164,116 B2 * 1/2007 Akagi ..... 340/557
7,466,224 B2 * 12/2008 Ward et al. ..... 340/556
2008/0042824 A1 * 2/2008 Kates ..... 340/556
2010/0256940 A1 10/2010 Ogawa et al.
2012/0038456 A1 * 2/2012 Pikkarainen et al. ..... 340/5.61

FOREIGN PATENT DOCUMENTS

EP 0 671 715 A1 9/1995
JP 2010-151682 A 7/2010

OTHER PUBLICATIONS

Search Report dated Sep. 22, 2011 for Corresponding EP patent application #11164049.6.

* cited by examiner

*Primary Examiner* — Thomas Mullen

(74) *Attorney, Agent, or Firm* — Nath, Goldberg & Meyer; Jerald L. Meyer; Katelyn J. Bernier

(57) ABSTRACT

A theft protection device (108, 110) for the detection of unauthorized intrusion or entrance into a protected area (104) is provided, wherein the protected area (104) is surrounded by a physical barrier (102) which has at least one access area (106) and which can be overcome outside the access area (106) by reaching over or surmounting, wherein the device (108, 110) comprises a laser scanner (108) which is arranged and oriented such that its surveillance plane (114) detects reaching over and surmounting of the barrier (102) to then output a theft signal. The device (108, 110) comprises an authorization device (110) of the access area (106) which is configured to activate or deactivate the laser scanner (108) upon authorized passage through the access area (106).

19 Claims, 3 Drawing Sheets

THEFT PROTECTION DEVICE AND METHOD FOR THE DETECTION OF UNAUTHORIZED INTRUSION OR ENTRANCE

The invention relates to a theft protection device and a method for the detection of unauthorized intrusion and entrance into a protected area surrounded by a physical barrier, which has at least one access area and is physically surmountable from outside the access area.

Shoplifting causes an enormous economic damage. Therefore, costly measures are taken to prevent theft and to catch the perpetrators. It is known to electronically label individual articles, for example with RFID tags, to detect the theft. The corresponding detection devices are usually positioned at an exit of the store. At that moment, the perpetrator is already leaving the store, and an arrest is only possible with considerable difficulties. Besides the alarm often being delayed, such electronic article surveillance systems have the disadvantage that the electronic reading can be relatively easily disabled by shielding.

Video surveillance is another conventional technique for theft prevention. Surveillance cameras are mounted at a fixed position which either have a fixed field of view or, as for example in case of dome cameras, a changing field of view. Images of the video surveillance are manually evaluated, or it is attempted to detect thefts from the recorded image data by means of motion capturing software. However, the video cameras have only a limited field of view, so that the camera usually moves through the respective areas at random. Often only blurred images are captured, and dangerous situations are not automatically detected because the camera is not an active sensor, but only passively generates image data. In addition, image quality may be impaired by shadowing, insufficient image changes, or too low a pixel contrast or image resolution, so that no alarm is triggered.

Inadequate security measures are commonly taken especially at sales counters that often are at the same time cashier areas. On the one hand, such areas are usually clearly limited by a counter or a bar. On the other hand, the situation constantly changes due to moving persons which complicate the automatic detection of critical moments. Therefore, surveillance is mostly done by the staff itself in these particularly risky areas. However, there is not always an employee in this area who does the task with the required attention. Then, the theft will not be noticed or be noticed too late. During a raid, were the perpetrator jumps across the counter, the staff rarely succeeds in triggering an alarm in time. Hence, the conventional protection of such counters, which are particularly attractive for thieves because of very high-quality goods or the register, is inadequate.

Figure 6:
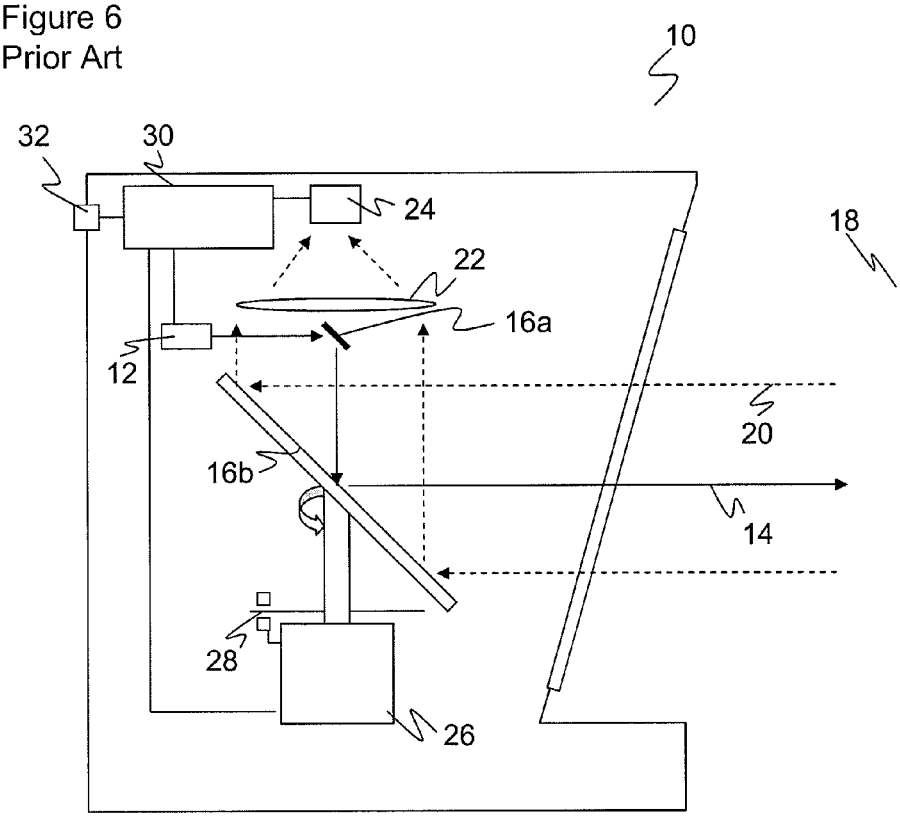
Figure 6 Prior Art

It is known to monitor the access to valuable items by means of a laser scanner. Such a conventional laser scanner is shown in FIG. 6 in a schematic sectional view. A light beam 14 generated by a light transmitter 12, for example a laser, is deflected into a surveillance plane 18 by deflection units 16*a-b* and is reflected if an object is present in the light path of the light beam 14. The reflected light 20 returns to the laser scanner 10 and is detected in a light receiver 24, for example a photo diode, via the deflection unit 16*b* and reception optics 22.

The light deflection unit 16*b* is usually made as a rotating mirror that continuously rotates driven by a motor 26. The respective angular position of the light deflection unit 16*b* is detected via an encoder 28. The light beam 14 generated by the light transmitter 12 thus scans the surveillance plane 18 generated by the rotational movement. When a reflected light signal 20 from the surveillance plane 18 is received in the light receiver 24, the angular position of the object can be derived from the angular position of the deflection unit 16*b* by means of the encoder 28.

In addition, the time of flight of individual laser light pulses from their transmission to the reception after reflection on the object in the surveillance plane 18 is determined. From the light time of flight, the distance of the object from the laser scanner 10 is derived based on the speed of light. This evaluation is carried out in an evaluation unit 30 that is connected to the light transmitter 12, the light receiver 24, the motor 26 and the encoder 28. Thus, with the angle and the distance, two-dimensional polar coordinates of all objects in the surveillance plane 18 are available. This information about object positions can be output via an interface 32.

By means of such a laser scanner, for example, sort of a virtual curtain can be formed in front of a valuable picture, and an alarm is triggered when somebody moves closer than allowed. This kind of protection cannot simply be transferred to a sales counter because presence in the protected area cannot be forbidden, since otherwise the sales personnel are unable to do their work.

It is therefore an object of the invention to improve the theft protection in areas like a sales counter or a wrapping counter.

This object is satisfied by a theft protection device and a method for the detection of unauthorized intrusions as described herein. In particular, there is provided a theft protection device for the detection of unauthorized intrusion or entrance into a protected area which is surrounded by a physical barrier which has at least one access area and which can be overcome outside the access area by reaching or jumping over, wherein the device comprises a laser scanner which is arranged and oriented such that its surveillance plane detects reaching over and surmounting of the barrier to then output a theft signal. The device comprises an authorization device for the access area which is configured to activate or deactivate the laser scanner upon authorized passage through the access area.

Furthermore, the object is also satisfied by a method for the detection of unauthorized intrusion or entrance into a protected area that is surrounded by a physical barrier which has at least one access area and which can be overcome outside the access area by reaching over or surmounting, wherein the area above or behind the barrier is surveyed with a laser scanner and wherein a theft signal is output upon detection of a reaching over or a surmounting. The laser scanner is activated or deactivated upon authorized passage through the access area.

The invention starts from the basic idea to monitor areas in the vicinity and in particular above and within the barrier, respectively, for reaching over and surmounting by means of a laser scanner. For enabling the sales staff to be present within the protected area without triggering a theft signal, the laser scanner is only activated as long as there is no authorized person within the protected area. To that end, an authorization device detects passages through the access area and checks whether these passages are authorized. Such an authorized passage then is the trigger for the activation or deactivation of the laser scanner. Preferably, factors like the movement direction of the passage and the number of persons that have already entered the protected area with authorization influence the activation decision, so that the laser scanner is active if and only if nobody from the staff is present within the protected area.

Unlike conventional theft protection devices, it is not monitored on the level of articles, but particularly critical areas are surveyed for access and intrusions based on the spatial conditions. Especially for areas delimited geometrically by a barrier, a surveillance technique is required that sets clear surveillance limits. At the same time, the limit has to be passable for the sales staff and their entrance and leaving of the protected area as well as the usual business activities, while at the same time being safe against theft attempts.

The invention has the advantage that in particular higher-valued goods that are usually stored or offered in an area protected by a barrier are better protected by appropriate measures. This is especially true for cash reserves, because cashiers are also often located in such areas delimited by a barrier. Each theft is detected early enough so that there is enough reaction time for securing evidence or catching the perpetrator. Due to the existing architecture and the design of the theft protection device, a retrofit and an adaption to the respective environment is easy. For this purpose, the laser scanner can preferably be connected to existing alarm devices by switching relay contacts and be mounted almost invisibly. Due to easy retrofit in existing systems, the theft protection device is an economic solution, and the period for return on invest is short because of the high reliability of the theft protection. By appropriate advertising, the determent is already increased even without the intervention of the theft protection device.

The invention provides a high reliability at a low false alarm rate and thus a high acceptance among the sales staff. The sales staff feels better protected against raids. Customer satisfaction is maintained despite the increased surveillance, because an honest customer does not come into contact with the theft protection or have reason to set off the alarm.

The protected area preferably is a cashier area or a sales area. The barrier preferably is a sales counter or a bar. Any preferable feature or preferable combination of features refers to preferred, but optional rather than mandatory embodiments throughout this description. High-valuable goods or even cash is often stored in cashier or sales areas. The barrier is usually formed by appropriate furniture. It is intended that a communication and an exchange of goods remains possible across the barrier. An abuse of this accessibility by thieves is reliably prevented by the invention.

The surveillance plane is preferably oriented horizontally and at least partially covers the protected area. Such a surveillance plane still allows any intervention above the barrier. However, as soon as a perpetrator tries to reach or even jump over the barrier, this is reliably detected.

The surveillance plane preferably directly contacts the upper edge of the barrier. A certain distance is also conceivable as an alternative, in particular if this distance is small enough to prevent an undetected intrusion with an entire arm or body. Similarly, a downward offset is possible, while of course the surveillance plane should not overlap with the barrier in that case. Such a surveillance plane also reliably detects reaching over and above all jumping into the protected area, and false alarms are virtually impossible because the surveillance plane cannot be reached by persons outside the barrier without the intention of an intrusion.

The surveillance plane preferably also covers an area in front of the barrier. However, detected intrusions into the area in front of the barrier preferably generate a presence detection signal instead of the theft signal. Detections of this kind do not serve the theft protection, because is should always be allowed to stay in front of the barrier. It may, however, be useful to detect presence of a person, for example to inform the sales staff about the presence of a customer. The position of the intrusion enables evaluations that determine the duration of presence in certain areas in front of the barrier, for example to evaluate the effect of promotions, advertising, or the attractiveness of displayed merchandise.

The surveillance plane is preferably arranged adjacent to the upper edge of the barrier, vertically or diagonally continuing the barrier upwards into the protected area. This enables a high mounting of the laser scanner. The physical barrier is complemented upwards by a virtual barrier. Depending on the inclination of the surveillance plane, approaching the protected area is forbidden more or less rigorously.

The laser scanner is preferably adapted to configure partial areas of the surveillance plane into which intrusions are permitted or not permitted. By configuring partial areas, a simple adaption to the local conditions is possible, in particular to a geometry of the barrier. This facilitates the use of or the retrofit to the theft protection device according to the invention, because the laser scanner is adapted rather than the barrier that already exists or is already defined by other considerations.

An alarm device is preferably provided which upon reception of the theft signal triggers an audible warning. This immediately draws attention to the thief in order to catch him or at least cause him to flee before valuable items can be stolen.

A video surveillance system is preferably provided which upon reception of the theft signal generates an image recording of the vicinity of the barrier. Consequently, the video system is activated specifically by an intrusion into the surveillance plane of the laser scanner. With help of such an event-controlled camera activation, evidence related to the perpetrators can be generated. This also preserves privacy because images are only recorded after a forbidden violation of the area monitored by the laser scanner. In contrast to a continuous camera surveillance, honest customers are not recorded. Since the surveillance is directly related to the scene of the crime, the cameras can be positioned and oriented in a specific way to provide sharp images clearly documenting the perpetrator and the crime. In principle, the camera can even be moved or one out of a plurality of cameras can be selected to specifically record the position of the intrusion detected by the laser scanner and, hence, the perpetrator. The event-related recoding has the additional advantage that significantly less image data is generated than with a continuous video surveillance, thus saving memory and computer equipment.

A video surveillance system is preferably provided which generates an image recording of the protected region as long as persons are present therein. This surveillance is complementary to an event-related image recording of a forbidden intrusion into the surveillance plane of the laser scanner. With that, evidence against insiders, i.e. the own sales staff, can be secured. Moreover, persons gaining unauthorized passage into the protected area without intervention of the authorization device, for example with another person's key or access code, are at least detected in retrospect. The recording can be restricted to a short duration after the authorization device has allowed passage for this additional person check.

The authorization device preferably includes a status memory to store information about authorized passages. Then, it is always known whether there is an authorized person within the protected area, and who it is. For example, if several persons have entered the protected area, the laser scanner is activated only after the last of these persons has once again left the protected area.

The authorization device preferably comprises an RFID reader or a code reader. Then, an RFID tag or an optical tag can be integrated into the work clothes of the sales staff. The authorizing for a passage is contactless and does not need any special action of the sales staff, thus increasing the acceptance of the theft protection device. By assigning specific codes, an access management is enabled, allowing or disallowing the sales staff access to certain areas depending on their position and function. Some examples for alternatives for a contactless access control are key cards or mechanical keys.

At least one additional sensor is preferably provided at the access area. The additional sensor also closes the barrier across the access areas. The theft signal can also be output when an unauthorized access through the access area is detected. Moreover, the additional sensor preferably also serves as a trigger for the authorization device for contactless authorization methods like RFID, because these techniques themselves today are typically not yet sufficiently position sensitive to detect when an authorization is necessary. The additional sensor preferably is a light barrier or a light grid for the detection of passages through the access area.

The theft protection device preferably comprises at least one additional sensor to detect intrusions into remaining gaps between the barrier and the surveillance plane. Some geometries of the barrier do not permit to detect all possibilities for a reaching over or a surmounting with only a single surveillance plane. Such monitoring gaps can be closed by additional sensors. The additional sensor preferably is a light barrier, a light grid or an additional laser scanner.

The laser scanner preferably comprises a light transmitter for transmitting a light beam into the surveillance plane, a light receiver for generating a reception signal from a remitted light beam remitted by objects in the surveillance plane, a movable deflection device for the periodic deflection of the light beam to scan the surveillance plane during the movement, and an evaluation unit for detecting objects based on the reception signal. This enables to monitor a surveillance plane over a large angle of up to 360° with a single sensor. Being an optical system, a laser scanner is flexible and can be used very economical.

The laser scanner is preferably configured as a distance meter in that the evaluation unit is configured to determine the light time of flight between transmission and reception of the light beam and from that the distance of an object. Thus not only the intrusion as such, but also the distance of the intrusion to the laser scanner is detected. The laser scanner preferably comprises an angle encoder configured to detect the angular position of the deflection unit. This serves the localization of intrusions in angular direction. If the laser scanner determines distances and angles, complete position information of the intrusion and thus objects detected in the surveillance plane is available in two-dimensional polar coordinates (Lidar). Therefore, the surveillance plane can be divided into fields in an arbitrary manner where intrusions are allowed or forbidden, and in this way be adapted to local conditions. It is also known for each intrusion at which position the intrusion took place, for example to rearrange or orient a camera, or to take staggered measures like merely switching on a warning sign, trigger an internal or external alarm, or even block the exits.

The method according to the invention can be developed further in a similar manner and shows similar advantages. Such advantageous features are exemplary, but not exclusively described in the sub claims following the independent claims.

Figure 1:
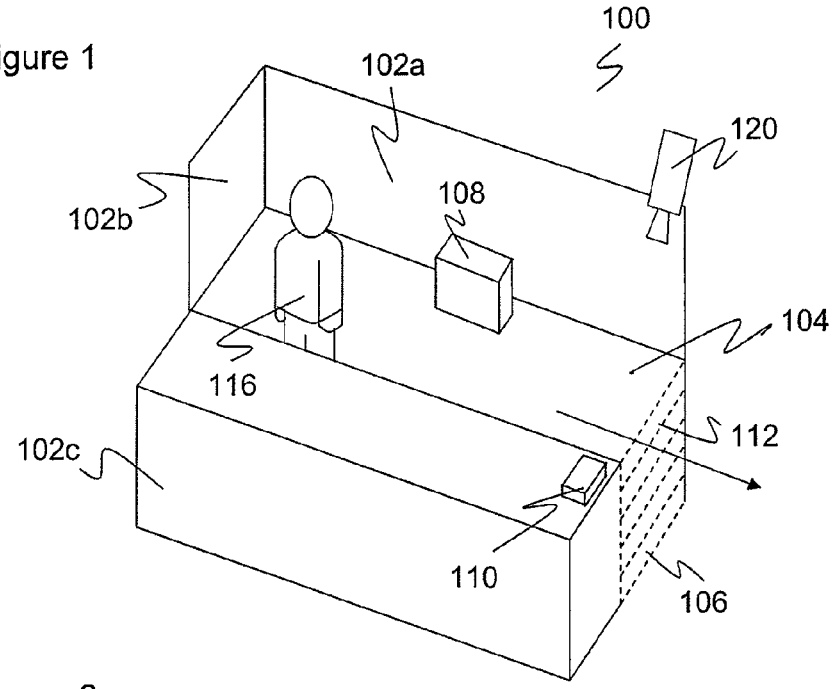
Figure 2:
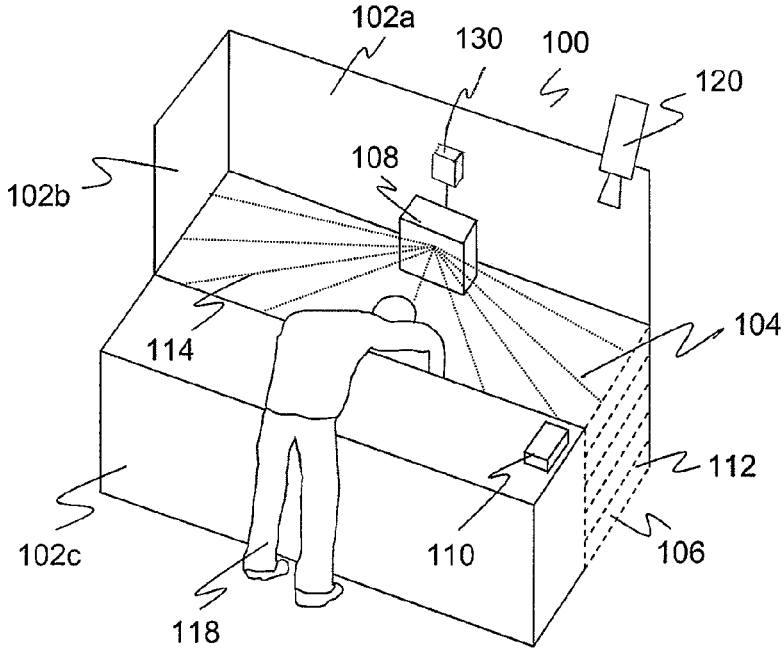
Figure 3:
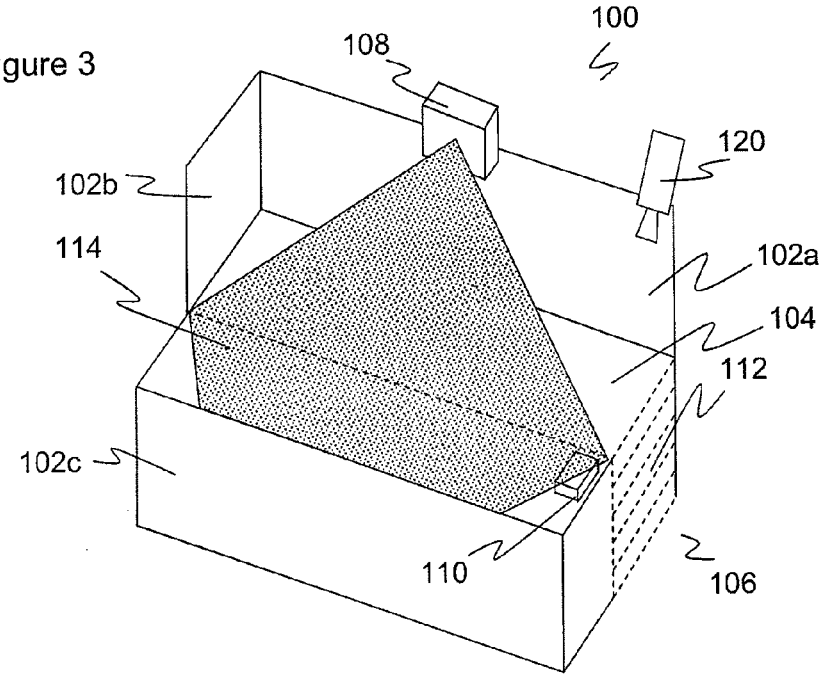
Figure 4:
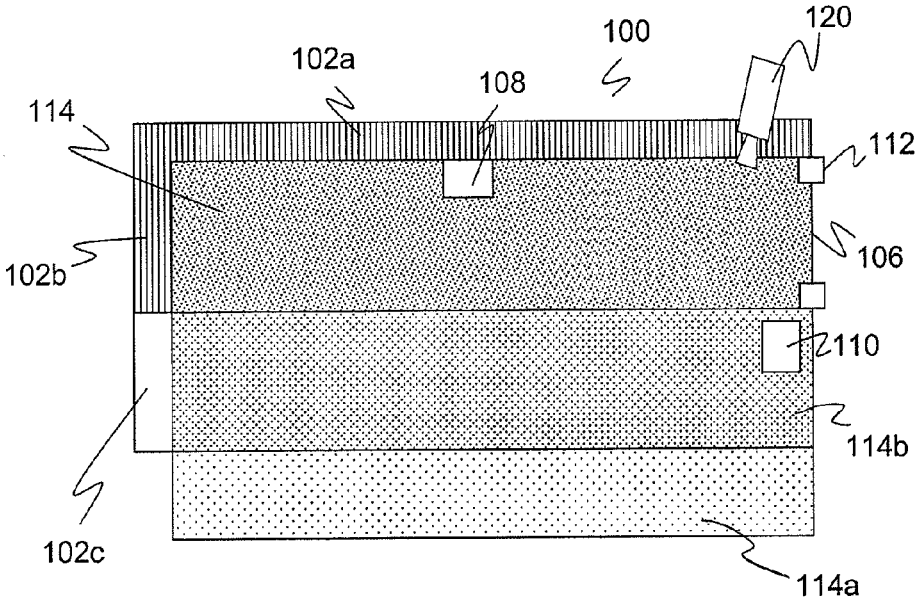
Figure 5:
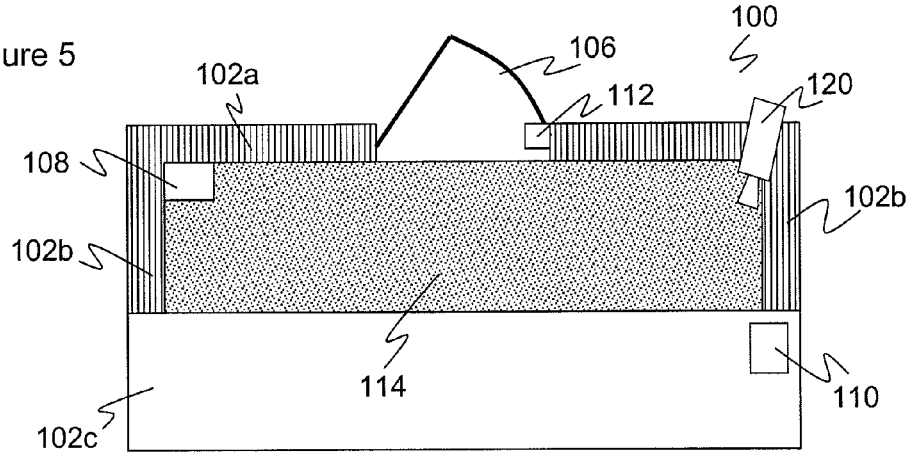

The invention will be explained in more detail below based on exemplary embodiments also in view of further features and advantages with reference to the drawing. The Figures of the drawing show in:

FIG. 1 a schematic three-dimensional view of a sales counter protected against theft during the presence of sales staff;

FIG. 2 a schematic three-dimensional view of an attempted theft at the sales counter according to FIG. 1 in the absence of sales staff;

FIG. 3 another schematic three-dimensional view of a sales counter in an alternative arrangement of a surveillance plane;

FIG. 4 a schematic plan view on a sales counter for another alternative arrangement of the surveillance plane which protrudes into an area in front of the sales counter;

FIG. 5 a schematic plan view on another example of a sales counter with an alternative access area; and FIG. 6 a schematic sectional view on an exemplary laser scanner according to the prior art that can be used in a theft protection device according to the invention.

FIGS. 1 and 2 each show a schematic three-dimensional view of a sales counter 100 with a theft protection device. The sales counter forms a surrounding physical barrier 102*a-c* around a protected area 104. Backwards and to the left, the barriers 102*a*, 102*b* are higher than a person, thus preventing any easy access by jumping over the barrier. To the front, the barrier 102*c* forms a half-height table or counter across which the sales staff can trade items with customers. On the right side an access area 106 is located where sales staff can enter and leave the protected area 104. The geometry of barriers 102*a-c*, protected area 104 and access area 106 as illustrated is to be understood purely as an example. Moreover, other applications with similar physical barriers 102*a-c* are possible, for example storage areas with restricted zones.

The theft protection comprises a laser scanner 108, an authorization device 110 and a light grid 112, the latter only shown by its monitoring beams. In this example, the laser scanner 108 is mounted so that its surveillance plane 114 is oriented horizontally and covering the protected area 104. The authorization device 110 is located near the access area 106, wherein the light grid 112 detects when somebody enters or leaves the protected area 104 based on beam interruptions.

In FIG. 1, an authorized sales person 116 is located behind the sales counter. Therefore, the laser scanner 108 is inactive, and for that reason its surveillance plane 114 is not shown in FIG. 1. However, in FIG. 2 the authorized sales person 116 has left the sales counter 100, and the laser scanner 108 is active and detects intrusions into the surveillance plane 114. If a thief 118 tries to exploit the absence of the sales person 16 and to steal an item from inside the sales counter 100, the reaching over the front barrier 102*c* of the sales counter 100 is detected by the laser scanner 108. It would also be detected if the thief 118 not only bends over the sales counter 100, but even climbs or jumps into the protected area 104.

The laser scanner 108 is for example configured as described in the introduction with reference to FIG. 6. As an actively scanning optical system, the laser scanner 108 works contactless and scans its surveillance plane 114 in two dimensions. Reflectors or position markers are not required. In an application for monitoring areas, monitoring fields can be configured that are linked to an internal output circuit. The surveillance plane 114 can thus be adapted to the barrier 102*a-c*, and different from the representation in FIG. 2 also partial areas can be defined which are not monitored. An external computer or other external evaluation is not necessarily required by the laser scanner 108 if the signals, i.e. the inputs and outputs, are processed within the laser scanner 108 itself and are subsequently output.

The measurement data of the laser scanner 108 are then available at an interface as raw data or directly as intrusions of a potential perpetrator into certain configured partial areas and positions, respectively. A real-time evaluation provides extremely fast response times.

The laser scanner 108 is mounted at the rear barrier 102*a* of the sales counter 100 in FIGS. 1 and 2 by way of example, wherein the surveillance plane 114 is arranged horizontally within the barrier 102*a-c*. The surveillance plane 114 is monitored for intrusions when the sales counter 100 is unattended as in FIG. 2, i.e. when no sales person 116 is present within the protected area 104.

In case that an intrusion is detected in this situation, such as the exemplary reaching over the sales counter 100 of the thief 118 in FIG. 2, the laser scanner 108 outputs a corresponding theft signal. To this end, the laser scanner 108 can be connected to an existing alarm device 130. Then, the staff is alerted and enabled to quickly check the situation and, if necessary, respond to the situation. Undesired warnings occur only very rarely, because the laser scanner 108 very specifically responds to inadmissible intrusions. Therefore, customer satisfaction, where in this context the sales personnel are also customers of the theft protection device, remains at a high level although the security against theft is significantly increased.

Instead of an alarm or in addition to the alarm, preferably also a surveillance camera 120 is activated to record the critical scenes after a detected intrusion. Since the position of the intrusion is known, the surveillance camera can be correctly oriented and focused. The surveillance camera 120 is thus enabled to provide sharp images of the event and the perpetrator on an event-driven basis.

It is in principle conceivable to use a different sensor than a laser scanner 108. A possible candidate is a light grid which however is more complicated to install and does not provide arbitrarily customizable monitoring fields. Moreover, other than a laser scanner 108, a light grid does not detect positions for a camera control and focusing with sufficient accuracy. Another possible alternative is a passive infrared detector that however does not delimit the monitored area with a centimeter precision in contrast to a laser scanner 108, so that an alarm may be triggered falsely or too early, or so that gaps in the monitoring remain. This affects the rate of undesired warnings and, consequently, customer satisfaction and acceptance of the sales staff on the one hand and security on the other. For those reasons, a laser scanner 108 is the preferred type of sensor.

The laser scanner 108 functions in connection with the authorization device 110 for the theft protection. The authorization device 110 detects whether a sales person 116 passes the access area 106 with proper authorization. Authorization methods like RFID, key cards or optical codes are used, wherein the authorization device 110 comprises a corresponding reading device and authorized sales persons 116 carry the corresponding RFID tag, code or key. A contactless authorization that is carried out automatically as completely as possible increases the comfort for the sales staff.

Passage through the access area 106 is preferably detected by an additional sensor, for example the light grid 112. This enables triggering the authorization device 110 and reliably preventing somebody passing the access area 106 unnoticed.

In case that a sales person 116 enters the protected area 104 via the access area 106, an authorization is carried out. If the sales person 116 is authorized, the surveillance field 114 of the laser scanner 108 is deactivated by an input signal to the laser scanner 108. Depending on the operating conditions, it is also conceivable to merely switch the surveillance field 114 in order to still monitor partial areas of the protected area 104. The various configurable monitored fields of the laser scanner 108 are used for that purpose. If the authorization fails, because it is not a sales person 116 or the sales person 116 is not authorized to enter, an alarm is triggered and/or the surveillance camera 120 is activated similar to the case when an intrusion of a thief 118 into the surveillance field 114 is detected. The authorization can also be used for an access management to only allow specific employees in specific areas.

It is also conceivable to activate the surveillance camera 120 at an authorized entry through the access area 106. Then, the protected area 104 is monitored just while an authorized sales person 116 is present therein. This serves to protect against insiders, i.e. their own personnel, or to find out about abuse of the authorization code.

Conversely, when the sales person 116 leaves the protected area 104 via the access area 106 in the situation of FIG. 1, an authorization is generally not required. However, the authorization device 110 preferably also stores this event to keep track of how many persons are located within the protected area 104, and who they are. Each leaving of the protected area 104 can for example be used to activate different partial areas of the surveillance plane 114. As soon as the as the last sales person 116 has left the protected area 104, the surveillance plane 114 as shown in FIG. 2 is activated.

Since a single surveillance plane 114 does not enable a gapless protection against intrusions for all situations and geometries of the barrier 102*a-c*, for example to prevent a dodging at the sides, additional sensors can be included in the theft protection, for example an additional laser scanner, and also light barriers and light grids, respectively. Dodging at the sides and other attempts at evasion of a thief are thus detected, and the corresponding security measures follow directly or via the laser scanner 108.

FIG. 3 shows another embodiment of the theft protection at a sales counter 100 in a schematic three-dimensional view. In contrast to the FIGS. 1 and 2, the laser scanner 108 is mounted at a higher position and monitors an oblique surveillance plane 114. The tilt angle of the surveillance plane 114 and the position of the laser scanner 108 can be varied to cover the protected area 104 at different heights and in varying degrees. The front barrier 102*c* can be within or outside as well as partially within the protected area 104 depending on the configuration. Because of the higher mounting position of the laser scanner 108, it is easier in some situations to keep the surveillance plane 114 free from articles on display. In principle, it is also possible to orient the surveillance plane 114 vertically, for example in direct upward continuation of the front barrier 102*c*.

FIG. 4 shows in a plan view another example of a barrier 102*a-c* and a configuration of the surveillance plane 114 which is preferably oriented horizontally, but protrudes over the sales counter 100 in a partial area 114*a*. Therefore, a part of the sales area in front of the sales counter 100 can additionally be monitored. Upon detection of an intrusion into the partial area 114*a* protruding to the front, the laser scanner 108 does not trigger a theft signal, but merely a presence signal, because staying in the partial area 114*a* is allowed. However, it is possible to signal to an absent sales person 116 in this manner that an interested customer is present in front of the sales counter 100 who possibly wants advice. Upon detection of an intrusion into a further partial area 114*b* of the surveillance plane 114 above the front barrier 102*c*, the laser scanner 108 triggers either the theft signal or the presence signal.

With help of the partial area 114*a* protruding into the front sales area, it can be determined based on the position or location of intrusions or presence how long a customer is interested in an article on display in that the duration of presence at specific positions or in partial fields is measured and output. This data can be used to evaluate the effect of promotions and advertising, and there are also indications for possible changes of the product range or variety or product arrangement for increasing sales.

FIG. 5 shows in a plan view similar to FIG. 4 another alternative arrangement of the barrier 102*a-c*, the access area 106, and the laser scanner 108 with its surveillance plane 114, which is preferably oriented vertically. Here, the barrier 102 is insurmountably closed on both sides. The protected area 104 is entered and left through an access area 106 made as a door. Therefore, the sensor 112 for monitoring passages is a door switch instead of a light grid. This is another one of numerous examples for possible arrangements and geometries of the sales counter 100, the barrier 102, the access area 106, and the surveillance plane 114 for theft protection.

In addition to the security functions, the invention may optionally also serve as a kind of access management. Then, it is recognized whether a person who enters the defined area behind the barrier 102 monitored by the laser scanner 108 is authorized to do so. By means of a contactless identification it informs whether the defined area is free or occupied, i.e. whether there is a person there. If that is the case, it can in addition be found out and notified whether this person is authorized to stay.

The invention claimed is:

1. A theft protection device (108, 110) for the detection of unauthorized intrusion or entrance into a protected area (104) surrounded by a physical barrier (102), which has at least one access area (106) and is physically surmountable from outside the access area (106) by reaching over or jumping over, wherein the device (108, 110) comprises:

a laser scanner (108) which is arranged and oriented such that a surveillance plane (114) of the laser scanner detects reaching over or jumping over the barrier (102) to then output a theft signal, wherein the laser scanner (108) is adapted to configure partial areas of the surveillance plane (114) into which intrusions are permitted or not permitted, characterized by an authorization device (110) for the access area (106) which is configured to activate or deactivate the laser scanner (108) based upon whether an authorized passage through the access area (106) has occurred.

2. The theft protection device (108, 110) according to claim 1, wherein the protected area is a cashier area or a sales area.

3. The theft protection device (108, 110) according to claim 1, wherein the barrier (102) is a sales counter (100) or a bar.

4. The theft protection device (108, 110) according to claim 1, wherein the surveillance plane (114) is oriented horizontally and at least partially covers the protected area (104).

5. The theft protection device (108, 110) according to claim 1, wherein the surveillance plane (114) also detects an area in front of the barrier (102).

6. The theft protection device (108, 110) according to claim 5, wherein detected intrusions into the area in front of the barrier (102) generate a presence detection signal instead of the theft signal.

7. The theft protection device (108, 110) according to claim 1, wherein an alarm device (130) is provided which upon reception of the theft signal triggers an audible warning.

8. The theft protection device (108, 110) according to claim 1, wherein a video surveillance system (120) is provided which upon reception of the theft signal generates an image recording of the vicinity of the barrier (102).

9. The theft protection device (108, 110) according to claim 1, wherein a video surveillance system (120) is provided which generates an image recording of the protected area (104) as long as persons (116) are present therein.

10. The theft protection device (108, 110) according to claim 1, wherein the authorization device (110) includes a status memory which stores information about authorized passages.

11. The theft protection device (108, 110) according to claim 1, wherein the authorization device (110) comprises an RFID reader or a code reader.

12. The theft protection device (108, 110) according to claim 1, wherein at least one additional sensor (112) is provided at the access area (106).

13. The theft protection device (108, 110) according to claim 12, wherein the additional sensor (112) is a light barrier or a light grid for the detection of passages through the access area (106).

14. The theft protection device (108, 110) according to claim 1, wherein the laser scanner (10, 108) comprises a light transmitter (12) for transmitting a light beam (14) into the surveillance plane (18, 114), a light receiver (24) for generating a reception signal from a reflected light beam (20) reflected by objects in the surveillance plane (18, 114), a movable deflection device (16) for the deflection of the light beam (14, 20) to scan the surveillance plane (18, 114) while moving, and an evaluation unit (30) for detecting the objects based on the reception signal.

15. The theft protection device (108, 110) according to claim 14, wherein the laser scanner (10, 108) is configured as a distance meter in that the evaluation unit (30) is configured to determine the light time of flight between transmission and reception of the light beam (14, 20) and from that, deduce the distance of a detected object.

16. The theft protection device (108, 110) according to claim 14, wherein the laser scanner (10, 108) comprises an angle encoder (28) configured to detect the angular position of the deflection device (16).

17. The theft protection device (108, 110) according to claim 14, wherein the laser scanner (10, 108) is configured as a distance meter in that the evaluation unit (30) is configured to determine the light time of flight between transmission and reception of the light beam (14, 20) and from that, deduce the distance of a detected object, and wherein the laser scanner (10, 108) comprises an angle encoder (28) configured to detect the angular position of the deflection device (16), which allows two-dimensional polar position coordinates for objects detected in the surveillance plane (18, 114) to be determined.

18. A method for the detection of unauthorized intrusion or entrance into a protected area (104) surrounded by a physical barrier (102), which has at least one access area (106) and is physically surmountable from outside the access area (106) by reaching over or jumping over, wherein a laser scanner (108) scans a surveillance plane (114) and a theft signal is output upon detection of a reaching over or a jumping over of the barrier (102), wherein the laser scanner (108) is adapted to configure partial areas of the surveillance plane (114) into which intrusions are permitted or not permitted, characterized in that the laser scanner (108) is activated or deactivated based upon whether an authorized passage through the access area (106) has occurred.

19. The method according to claim 18, wherein the protected area (104) is a cashier area or a sales area.

* * * * *